United States Patent [19]

Moody

[11] Patent Number: 5,044,253

[45] Date of Patent: Sep. 3, 1991

[54] SUBMARINE WEAPON LAUNCH SYSTEM USING AN EXTERNAL IMPULSE TANK

[75] Inventor: Paul E. Moody, Barrington, R.I.

[73] Assignee: The United States of America as represented by the Secretary of the Navy, Washington, D.C.

[21] Appl. No.: 568,303

[22] Filed: Aug. 15, 1990

[51] Int. Cl.[5] ..... F41F 3/10; B63B 3/13

[52] U.S. Cl. ..... 89/1.810; 114/238; 114/318

[58] Field of Search ..... 89/1.810, 1.809; 114/318, 319, 316, 238

[56] References Cited

U.S. PATENT DOCUMENTS

| | | | |
|---|---|---|---|
| 2,848,970 | 8/1958 | Gunning | 114/319 |
| 3,183,904 | 5/1965 | Barakauskas | 89/1.810 |
| 3,516,380 | 6/1970 | Johnston | 114/238 |
| 3,670,692 | 6/1972 | Jackson | 89/1.810 |
| 3,807,274 | 4/1974 | Cohen | 114/238 |
| 4,523,538 | 6/1985 | Hollmann et al. | 114/238 |
| 4,848,210 | 7/1989 | Bissonnette | 89/1.810 |

*Primary Examiner*—David H. Brown
*Attorney, Agent, or Firm*—Michael J. McGowan; Prithvi C. Lall; Michael F. Oglo

[57] ABSTRACT

A submarine weapon launch system utilizing an external impulse tank. A submarine has at least one cylindrical torpedo tube that has a breechward section residing within the pressure hull of the submarine and a muzzleward section residing outside the pressure hull. An impulse tank is mounted outside the pressure hull provides impulse water to the breechward section of the torpedo tube. A hull insert encases a space about a portion of both the breechward and muzzleward sections of the torpedo tube. The hull insert provides for venting of the encased space to the impulse tank outside the pressure hull and for venting of the encased space to the breechward section within the pressure hull. The hull insert protects the torpedo tube from pressure hull distortions while the encased space transports impulse water from the impulse tank to the breechward section of the torpedo tube.

3 Claims, 1 Drawing Sheet

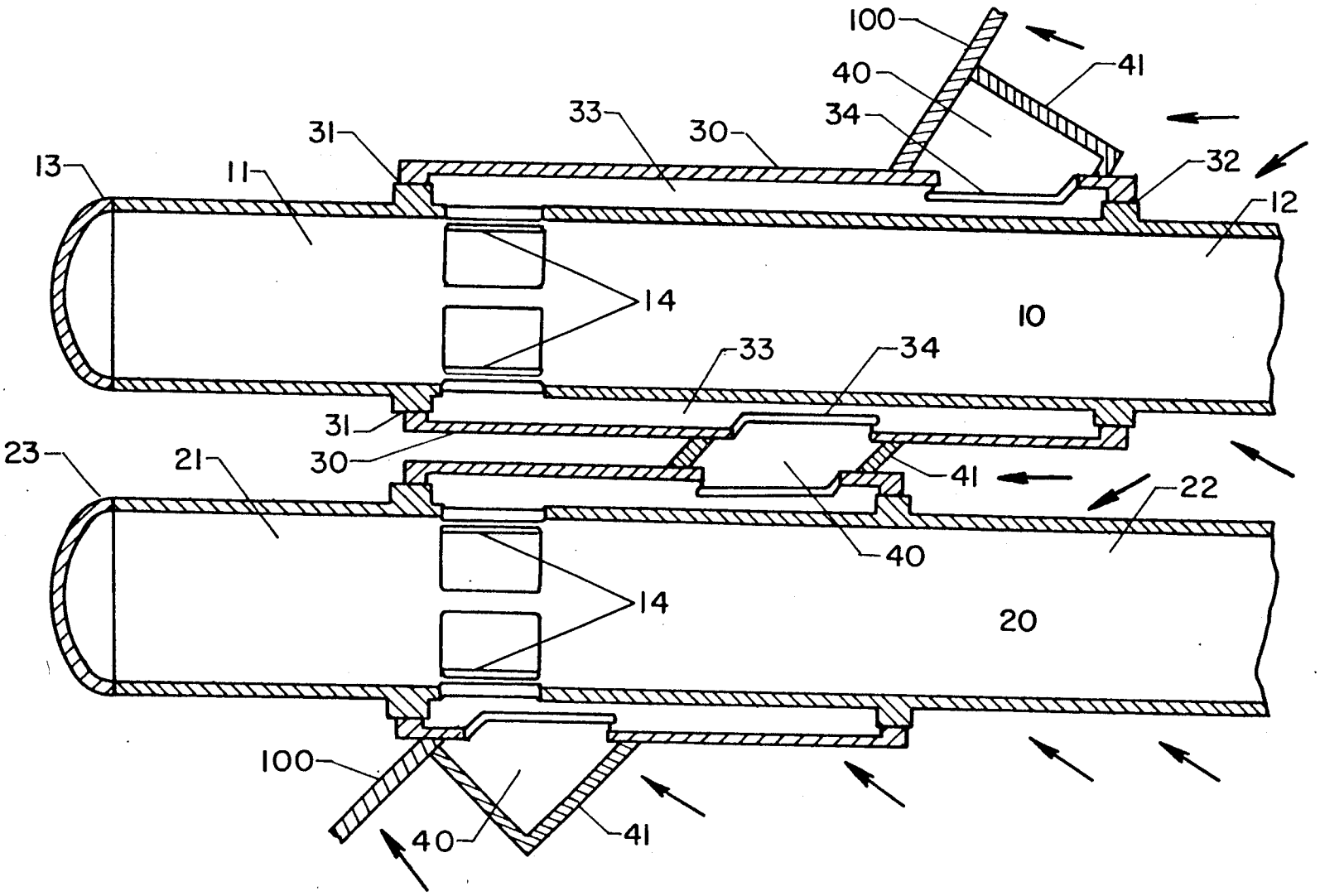
12
32
41
100
40
34
30
33
31
11
13
10
14
34
33
31
30
22
41
40
20
14
21
23
41
40
100

SUBMARINE WEAPON LAUNCH SYSTEM USING AN EXTERNAL IMPULSE TANKcl STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention generally relates to submarine torpedo systems and more particularly to a submarine torpedo system utilizing an external impulse tank.

(2) Description of the Prior Art

The Navy has a great interest in minimizing its ships' manufacturing costs. One way to accomplish this is to utilize designs which minimize space and weight requirements of the ship's sub-systems. This provides not only the direct benefit of a smaller and therefore less costly sub-system, but also provides the potential for a smaller ship if enough space and weight is saved.

Present submarine torpedo launch systems are constructed such that an ejection system draws water through an inlet pipe and forces it through a connecting or impulse tank to a breech end of a torpedo tube. As the ejection system over-pressures the breech end of the torpedo tube, this creates a pressure differential across a weapon in the torpedo tube. This pressure differential launches the weapon. More than one torpedo tube is connected to an impulse tank. Therefore, by selectively blocking or unblocking openings from the impulse tank to an individual torpedo tube, weapons can be fired from more than one torpedo tube by a single ejection system.

In order to simplify the design of the impulse tank, the torpedo tube openings or slide valve ports are oriented one over another at the same forward/aft and athwartship location. This orientation also permits the torpedo tube's breech faces to be at the same forward and aft position. This is desirable so that the torpedo tube locations can be compatible with the ship's weapon handling and stowage system. However, since the entire impulse tankage/tube system is located within the submarine's pressure hull, it is subjected to submergence pressure. Thus, all tanks, inlet pipes, torpedo tubes, and connecting valves must be capable of withstanding the submergence pressure. In fact, the flat walls of the impulse tanks in the Navy's most recently designed ship vary from 3½ to 5¼ inches thick. The weight of the impulse tank is significant because both the forward and aft walls of the tank are completely in the torpedo room.

SUMMARY OF THE INVENTION

Accordingly, it is an object of the present invention to provide a submarine weapon launch system that reduces the overall weight and size of the system compared with conventional designs.

It is a further object of the present invention to provide a submarine weapon launch system that is of simple and therefore inexpensive construction.

Other objects and advantages of the present invention will become apparent hereinafter in the specification and drawing.

In accordance with the present invention, a submarine weapon launch system is provided that utilizes an external impulse tank. A submarine has at least one cylindrical torpedo tube that has a breechward section residing within the pressure hull of the submarine and a muzzleward section residing outside the pressure hull. An impulse tank is mounted outside the pressure hull and provides impulse water to the breechward section of the torpedo tube. A hull insert encases a space about a portion of both the breechward and muzzleward sections of the torpedo tube. The hull insert provides for venting of the encased space to the impulse tank outside the pressure hull and for venting of the encased space to the breechward section within the pressure hull. The hull insert protects the torpedo tube from pressure hull distortions while the encased space transports impulse water from the impulse tank to the breechward section of the torpedo tube.

BRIEF DESCRIPTION OF THE DRAWING

The FIGURE shows a cross-sectional side-view of the weapon launch system utilizing an external impulse tank according to the present invention.

DESCRIPTION OF THE PREFERRED EMBODIMENT

Referring now to the FIGURE, there is shown a cross-sectional side-view of a submarine weapon launch system according to the present invention. Cylindrical torpedo tubes 10 and 20 are shown with breechward ends 11 and 21, respectively, and muzzleward ends 12 and 22, respectively. Breech doors 13 and 23 are provided to allow the insertion of a weapon (not shown) in the tubes 10 and 20, respectively. For sake of simplicity, the description will focus mainly on tube 10, however the teachings of the present invention also apply to tube 20 and its associated systems as well as any other torpedo tubes present on the submarine.

Torpedo tube 10 passes through the submarine pressure hull 100 such that breechward end 11 resides within the submarine and muzzleward end 12 is outside the hull 100. Present design practices dictate that torpedo tube 10 is welded into a hull insert 30 at forward 32 and aft 31 faces of hull insert 30 in lieu of directly into the hull 100. The hull insert 30 is cylindrical in shape and is designed so that when the hull 100 contracts due to sea pressure (sea pressure is generally indicated by the arrows in the FIGURE), hull insert 30 will distort in lieu of the torpedo tube 10 distorting. This not only helps to keep torpedo tubes cylindrical, but also helps to limit misalignment between the torpedo tube, the weapon handling system and the launch system's fire control axis.

In order to reduce the weight of the launch system, the impulse tank 40 is located outside the pressure hull 100. In this way, the hull 100 acts as one wall of impulse tank 40. Since the remaining wall 41 of tank 40 is only subjected to launch system ejection pressure, wall 41 need not be as thick as the conventional internal impulse tank. This relates to the fact that external impulse tank 40 can be normally pressure equalized with sea pressure, so that wall 41 of tank 40 is pressure balanced on both side of wall 41. Typically, the wall 41 need only be approximately 5/8 of an inch thick. This is a great improvement over conventional impulse tanks which have walls that range from 3½ to 5¼ inches thick.

In operation, transportation of impulse water from impulse tank 40 is accomplished by making use of the space 33 created between the hull insert 30 and torpedo tube 10. Hull insert 30 is vented to impulse tank 40 via an opening 34. The impulse water travels from the tank 40 through the space 33 and is imparted to the breechward end 11 of torpedo tube 10 through slide valve ports 14. The impulse water at the breechward end 11 of the torpedo tube 10 is then pressurized to exceed sea pressure by ejection pump system (not shown) in order to create the pressure differential needed to launch a weapon.

The advantages of the present invention are numerous. The system of the present invention locates a low pressure impulse tank outside the pressure hull to take maximum advantage of the weight saving associated with utilizing the pressure hull as one wall of the impulse tank. By utilizing the space between the hull insert and torpedo tube to transport the impulse water, the slide valve ports can be inside the pressure hull while the impulse tank is outside the pressure hull. This configuration eliminates the need for long torpedo tubes since the breechward end of the tube is within the pressure hull. In addition, the hull insert protects the torpedo tube from pressure hull distortions.

Thus, it will be understood that various changes in the details, materials, steps and arrangement of parts, which have been herein described and illustrated in order to explain in the nature of the invention, may be made by those skilled in the art within the principle and scope of the invention as expressed in the appended claims.

What is claimed is:

1. In a submarine having a torpedo weapon system, a torpedo launch tube arrangement comprising:

at least one torpedo tube having a breechward section residing within said submarine and a muzzleward section residing outside said submarine wherein a portion of said torpedo tube between said breechward and muzzleward sections passes through a section of the hull of said submarine;

an impulse tank mounted on the outside of said hull for providing impulse water to said torpedo tube; and a means for transporting said impulse water to said breechward section of said torpedo tube.

2. An arrangement according to claim 1 wherein said torpedo tube is cylindrical.

3. In a submarine having a torpedo weapon system, a torpedo launch tube arrangement comprising:

at least one torpedo tube having a breechward section residing within said submarine and a muzzleward residing outside said submarine wherein a portion of said torpedo tube between said breechward and muzzleward sections passes through a section of the hull of said submarine, said breechward section further being provided with a means for allowing water to enter said breechward section;

a hull insert encasing a space about a portion of said torpedo tube, said encased portion including at least: a) said breechward section having said water entry means, b) said portion of said torpedo tube passing through said hull and c) a portion of said muzzleward section, said portion of said muzzleward section further being provided with means for allowing water to enter said hull insert space; and an impulse tank mounted on the outside of said hull for providing impulse water to said hull insert space at said portion of said muzzleward section whereby said impulse water travels through said hull insert space and is imparted into said breechward section via said breechward section water entry means.

* * * * *